US006661345B1

(12) United States Patent
Bevan et al.

(10) Patent No.: US 6,661,345 B1
(45) Date of Patent: Dec. 9, 2003

(54) ALERTNESS MONITORING SYSTEM

(75) Inventors: Matthew G. Bevan, Silver Spring, MD (US); Henry A. Kues, Sykesville, MD (US); Carl V. Nelson, Rockville, MD (US); Paul R. Schuster, Baltimore, MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 09/691,893

(22) Filed: Oct. 19, 2000

Related U.S. Application Data

(60) Provisional application No. 60/161,207, filed on Oct. 22, 1999.

(51) Int. Cl.[7] ..... G08B 23/00

(52) U.S. Cl. ..... 340/575; 340/576

(58) Field of Search ..... 340/435, 438, 340/575, 576, 573.1, 425.5, 436, 439; 600/473, 476, 483, 534, 459, 300, 544, 545; 128/272, 274; 280/375; 180/271, 272

(56) References Cited

U.S. PATENT DOCUMENTS

| | | | | | |
|---|---|---|---|---|---|
| 4,836,219 | A | * | 6/1989 | Hobson et al. | 340/575 |
| 5,653,462 | A | * | 8/1997 | Breed et al. | 280/735 |
| 5,684,460 | A | * | 11/1997 | Scanlon | 340/573.1 |
| 5,689,241 | A | * | 11/1997 | Clarke, Sr. et al. | 340/575 |
| 5,691,693 | A | * | 11/1997 | Kithil | 340/575 |
| 6,062,216 | A | * | 5/2000 | Corn | 600/534 |
| 6,070,098 | A | * | 5/2000 | Moore-Ede et al. | 600/544 |
| 6,087,941 | A | * | 7/2000 | Ferraz | 340/575 |

* cited by examiner

*Primary Examiner*—Van T Trieu
(74) *Attorney, Agent, or Firm*—Francis A. Cooch

(57) ABSTRACT

A system and method for monitoring the alertness of a subject are provided. A Doppler sensor is disposed to sense a parameter pertaining to the subject, the sensor being one of an acoustic sensor and a microwave sensor. Signals from the sensor are processed through an alertness monitoring algorithm for generating processed signals. It is thereafter determined whether an impairment of alertness event pertaining to the subject has occurred based on the processed signals. Feedback is then provided to the subject based on a determination of whether an impairment of alertness event pertaining to the subject has occurred.

26 Claims, 9 Drawing Sheets

ALERTNESS MONITORING SYSTEM

CROSS REFERENCE TO RELATED APPLICATION

This application claims the benefit of prior filed co-pending U.S. application Ser. No. 60/161,207 filed Oct. 22, 1999.

BACKGROUND OF THE INVENTION

1. Field of Invention

The present invention relates to alertness monitoring systems and to methods of monitoring alertness, and, in particular, to systems and methods for monitoring the alertness of drivers, such as drivers of vehicles, including motor vehicles, trains, airplanes, boats and the like, and to systems and methods for monitoring the alertness of security personnel.

2. Description of the Related Art

The injuries and deaths resulting from crashes involving fatigued and sleepy drivers have led to increasing concern. For this reason, various motor vehicle alertness monitoring systems have is been provided that, among other things, monitor the onset of drowsiness of the driver.

Existing sensor technologies for monitoring the drivers of motor vehicles, and especially for monitoring the onset of drowsiness, include systems designed to measure eye closure. One such system is called the PERCLOS system developed by the University of Virginia. PERCLOS is defined as the portion of time within a one minute time interval during which the eyes are occluded at least 80%. The PERCLOS system (as further developed by Carnegie-Mellon University) uses two different wavelengths of infrared (IR) radiation (850 nm and 950 nm) to illuminate a driver's face and an IR camera to view the driver's face and make measurements of the auto-reflection of the eye. The eye is fairly transparent to the 850 nm radiation until the retinal surface at the back of the eye. At the retina, the radiation is reflected, causing a phenomenon known as the "glowing pupil" effect. The 950 nm radiation, on the other hand, is mostly absorbed by the water molecules in the eye, therefore producing almost no reflection. The image obtained from the 950 nm radiation is subtracted from the image obtained with the 850 nm radiation, resulting in an image that contains only the retinal reflections. The PERCLOS device utilizes the above approach to detect and measure eye blink by measuring how the eyelids obscure this auto-reflection.

The above system has at least three disadvantages. First, use of the PERCLOS system in sunlight presents significant problems, since the incident sunlight IR can overwhelm detection from the measurement of the auto-reflection of the IR energy. Second, the IR energy cannot effectively pass through sunglasses, thus making use of the PERCLOS system on a driver wearing sunglasses practically superfluous. Third, the system does not function effectively with individuals having dark skin pigment, since the pigment is also found in the eye, which significantly reduces the reflected intensity of the 850 nm IR radiation. Although various methods of overcoming these disadvantages have been proposed, none of them have shown the desirable level of effectiveness. One such method has been proposed to increase the incident IR energy on the eye. However safety limitations on eye exposure to IR energy prevent such a measure. Another such method is the provision of video systems that would eliminate the need for IR imaging altogether. Yet another such method, which aims at overcoming the effect of sunlight, is to use a pulsed IR radiation source and to detect the pulsed reflection with a pulsed synchronized detector. However, these systems are still in the early stages of development and have not yet provided appreciable results In addition, it has not been uncommon for security personnel, such as those sitting in front of TV security monitors, especially for mission critical monitoring such as at nuclear sites, to lose their alertness, such as by becoming drowsy and falling asleep. In this way, the security and safety of those sites has been compromised.

SUMMARY OF THE INVENTION

The present invention overcomes the drawbacks of alertness monitoring systems of the prior art while advantageously allowing alertness monitoring, and, in particular, the monitoring of the alertness of drivers, such as drivers of vehicles, including motor vehicles, trains, airplanes, boats and the like, or the monitoring of security personnel, for the purpose of detecting the onset of drowsiness.

The present invention provides an alertness monitoring system for monitoring the alertness of a subject; The system comprises a Doppler sensor adapted to sense a parameter pertaining to the subject, the sensor being one of an acoustic sensor and a microwave sensor; and control electronics adapted to be coupled to the sensor for processing signals therefrom. The control electronics include a processing device having an alertness monitoring algorithm embedded therein adapted to process the signals from the sensor thereby generating processed signals and to determine whether an impairment of alertness event pertaining to the subject has occurred. The control electronics further include a stimulus control coupled to the processing device and being controlled by the alertness monitoring algorithm for providing feedback to the subject based on a determination of whether an impairment of alertness event pertaining to the subject has occurred.

The present invention further provides a method for monitoring the alertness of a subject comprising the steps of: disposing a Doppler sensor to sense a parameter pertaining to the subject, the sensor being one of an acoustic sensor and a microwave sensor; processing signals from the sensor through an alertness monitoring algorithm for generating processed signals; determining whether an impairment of alertness event pertaining to the subject has occurred based on the processed signals; and providing feedback to the subject based on a determination of whether an impairment of alertness event pertaining to the subject has occurred.

In addition, the present invention pertains to an alertness monitoring system comprising: a Doppler sensing means disposed to sense a parameter pertaining to the subject, the sensing means being one of an acoustic sensor and a microwave sensor; means adapted to be coupled to the sensing means for processing signals therefrom thereby generating processed signals and for determining whether an impairment of alertness event pertaining to the subject has occurred; and means coupled to the means for processing for providing feedback to the subject regarding a determination of whether an impairment of alertness event pertaining to the subject has occurred.

It is to be understood that both the foregoing general description and the following detailed description are exemplary and explanatory only and are only intended to provide a further explanation of the present invention, as claimed. The accompanying drawings, which are incorporated in and constitute a part of this application, illustrate several exemplary embodiments of the present invention and together with description, serve to explain the principles of the present invention.

BRIEF DESCRIPTION OF THE DRAWINGS

The invention may be more fully understood with reference to the accompanying figures. The figures are intended to illustrate exemplary embodiments of the present invention without limiting the scope of the invention.

DETAILED DESCRIPTION OF THE PRESENT INVENTION

Figure 1:
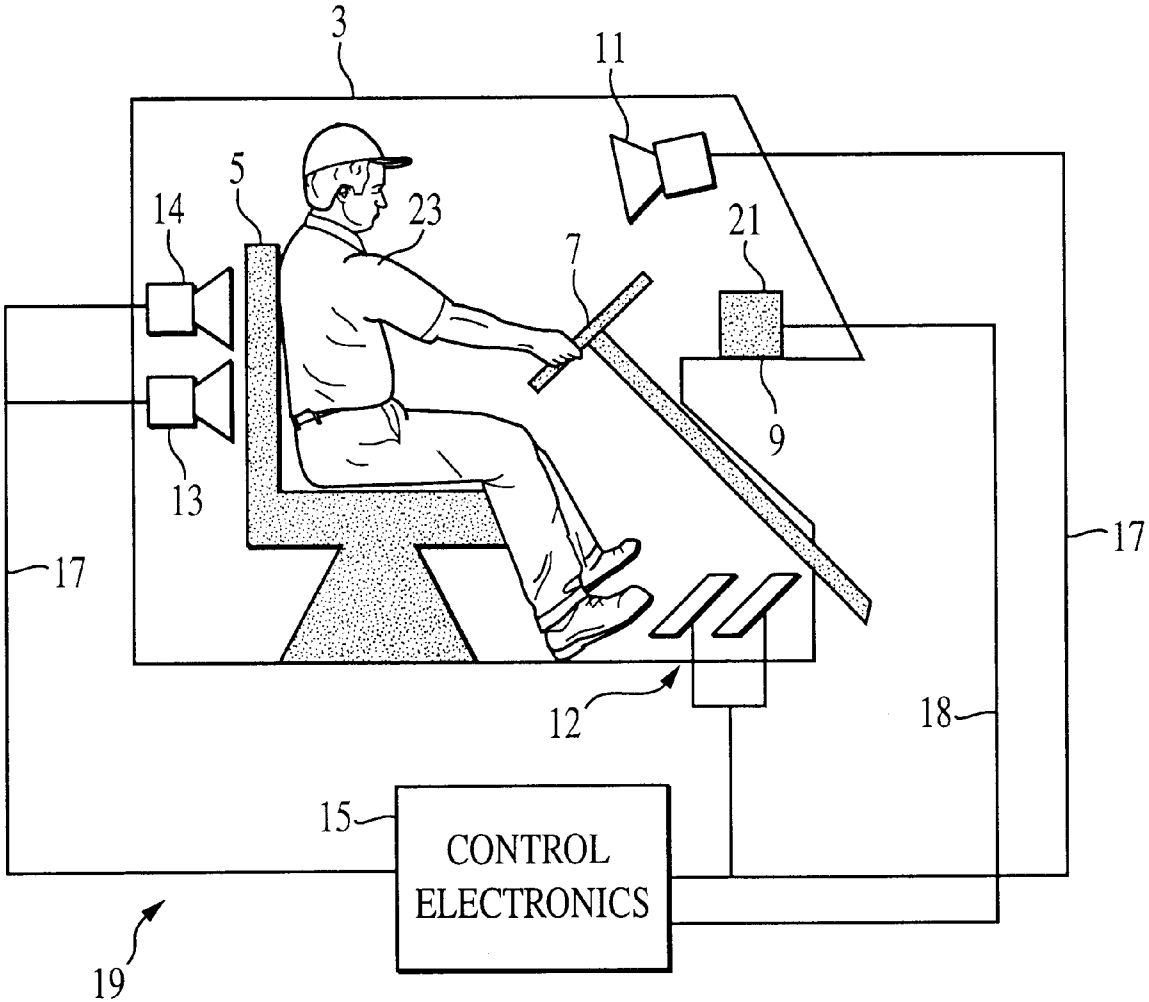
FIG. 1 is a schematic view of an embodiment of an alertness monitoring system according to the present invention, shown coupled to a truck cab.

The present invention provides an alertness monitoring system for monitoring the alertness of a subject. The system comprises a Doppler sensor adapted to sense a parameter pertaining to the subject, the sensor being one of an acoustic sensor and a microwave sensor. Control electronics are adapted to be coupled to the sensor for processing signals therefrom. The control electronics include a processing device having an alertness monitoring algorithm embedded therein adapted to process the signals from the sensor thereby generating processed signals. The algorithm also determines whether an impairment of alertness event pertaining to the subject has occurred. The control electronics further include a stimulus control coupled to the processing device and being controlled by the alertness monitoring algorithm for providing feedback to the subject based on a determination of whether an impairment of alertness event pertaining to the subject has occurred.

The present invention further provides a method for monitoring the alertness of a subject. A Doppler sensor is disposed to sense a parameter pertaining to the subject, the sensor being one of an acoustic sensor and a microwave sensor. Signals from the sensor are processed through an alertness monitoring algorithm for generating processed signals. It is thereafter determined whether an impairment of alertness event pertaining to the subject has occurred based on the processed signals. Feedback is then provided to the subject based on a determination of whether an impairment of alertness event pertaining to the subject has occurred.

The present invention relates to an alertness monitoring system and method, in particular for the detection of drowsiness in a driver of a vehicle, or for the detection of drowsiness of security personnel. Doppler microwave measures the motion of the object in its path. When people are awake, they fidget and move. When they are drowsy, this motion slows down, changes character and may stop. By monitoring this motion, assessment can be made of alertness. Additional processed data can provide information on eye blink, heart rate and respiration, which can give further insight on the physiologic state of the individual. Test data show that sleep onset occurs several minutes after this fidgeting/motion is significantly reduced. After fidgeting/motion has dropped below a predetermined threshold level, a secondary measurement could be made on eye blink in order to provide an additional, more detailed assessment of the onset of drowsiness. The sensing period to minimize false alarms is dependent on the time history of the measurements (adaptive) and the conditions of the measurements and the application, for example, 30 seconds.

The principles of detecting motion using acoustic waves are the same as those using microwaves. Therefore, the alertness monitoring system and method of the present invention may use either microwaves and acoustic waves to achieve its function, but preferably microwaves to measure eye blink. Although the instant specification describes more specifically the use of Doppler microwave sensors, it is to be understood that acoustic waves could also be used under the principles of the present invention, in conjunction with or instead of microwaves. Accuracy of results can be increased by "fusing" parameters (such as, in the case of monitoring a driver of a vehicle, vehicle parameters including speed, vehicle altitude, and steering wheel position) with sensor data before inputting into the present invention's algorithm for driver monitoring.

Referring now to FIG. 1, the environment in which an embodiment of the monitoring system of the invention may be installed includes, by way of example, a truck cab 3 including a driver's seat 5, a steering wheel 7 and a dashboard 9. It is noted that the arrangement shown in FIG. 1 is merely an example, the monitoring system of the present invention being adapted to be used in a great number of situations where alertness would need to be monitored. The shown embodiment 19 of the monitoring system of the present invention includes a series of Doppler radar sensors 11, 13 and 14, sensor 11 having been positioned forward of the driver's seat 5 above dashboard 9 to sense eye blink and general movement from driver 23, and sensors 13 and 14 having been positioned behind the driver's seat 5 in order to monitor the breathing and heart rate of the driver. In the context of the present disclosure, "eye blink" encompasses both eye blink frequency and duration of eye closure. Depending on the configuration of the system and the angle of the incident radiation to the eyes, the eye closures may be represented by a bipolar waveform while the eye openings produce a unipolar waveform. This allows for a direct measurement of the duration of eye closure. Additionally, sensors 12 are positioned to sense steering wheel motion, brake operation and accelerator operation. Embodiment 19 in FIG. 1 therefore depicts a multiple sensor monitoring system according to the present invention. Sensors 11, 12, 13 and 14 are in signal communication via lines 17 with control electronics 15, which process and monitor the signals therefrom. A typical base frequency range for the Doppler sensors that use microwaves is about 24–36 GHz, especially where eye blink and/or general movement are being monitored. The stated base frequency range represents a preferred base frequency range for microwave sensors according to the present invention, it being understood that other base frequency ranges for the Doppler sensors are also within the scope of the present invention. The base frequency would be dependent on the parameter being sensed, the higher frequencies being better suited to movements marked by smaller displacements (such as eye blink), and the lower frequencies being better suited to movements marked by larger displacements (such as fidgeting). The larger range of base frequencies for the Doppler microwave radars may thus be about 10–60 GHz. An alarm 21 is further provided as part of monitoring system 19, the alarm being in signal communication with control electronics 15 via line 18. It is to be understood that the signal communication between the respective components in monitoring system 19, namely, between is sensors 11, 13 and 14 and alarm 21 on the one hand, and control electronics 15 on the other hand, may be established through conventional means other than lines 17 and 18, such as, for example, through wireless communication.

Figure 2:
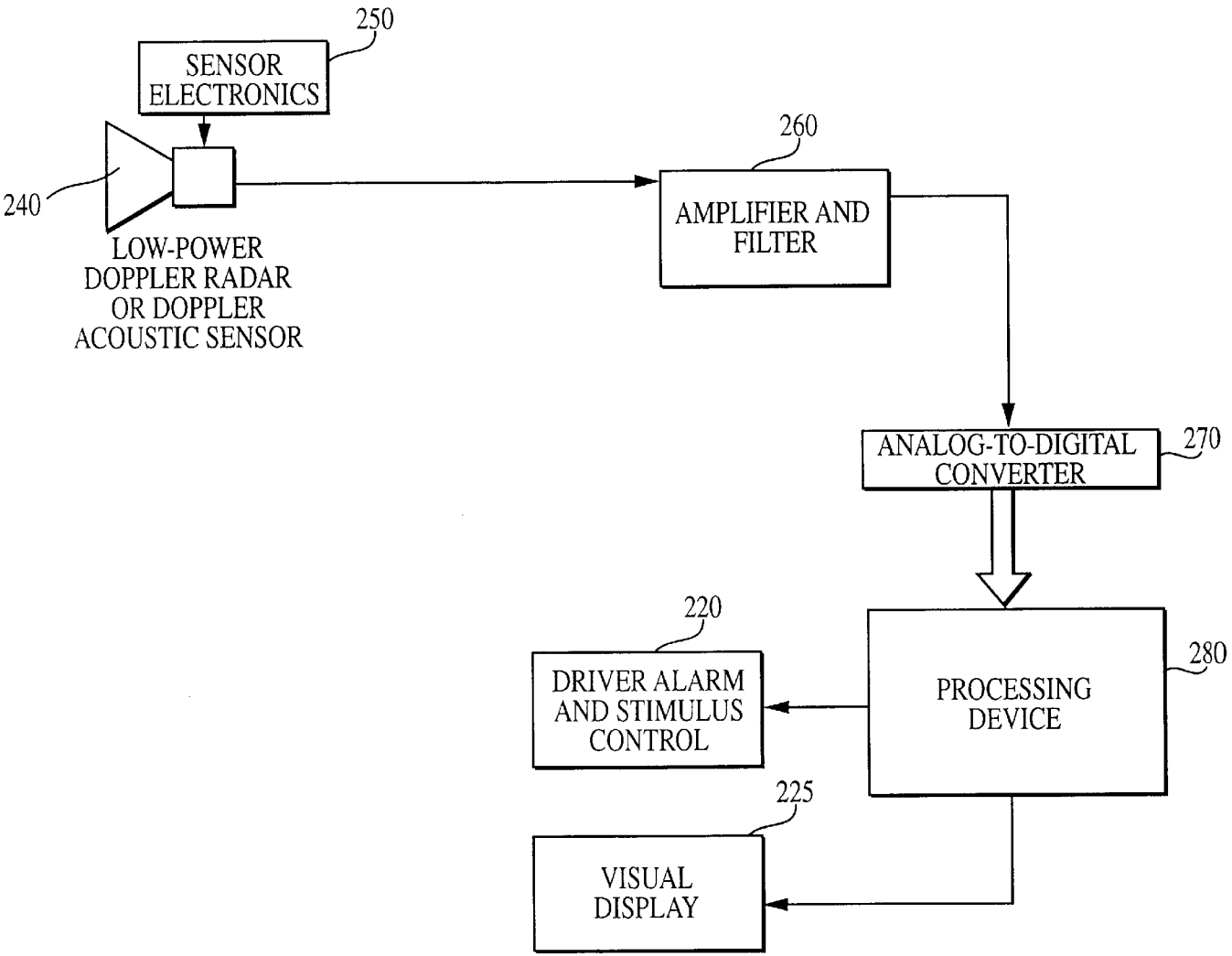
FIG. 2 is a schematic view of an embodiment of the control electronics of the alertness monitoring system according to the present invention, shown coupled to a single sensor.
Figure 3:
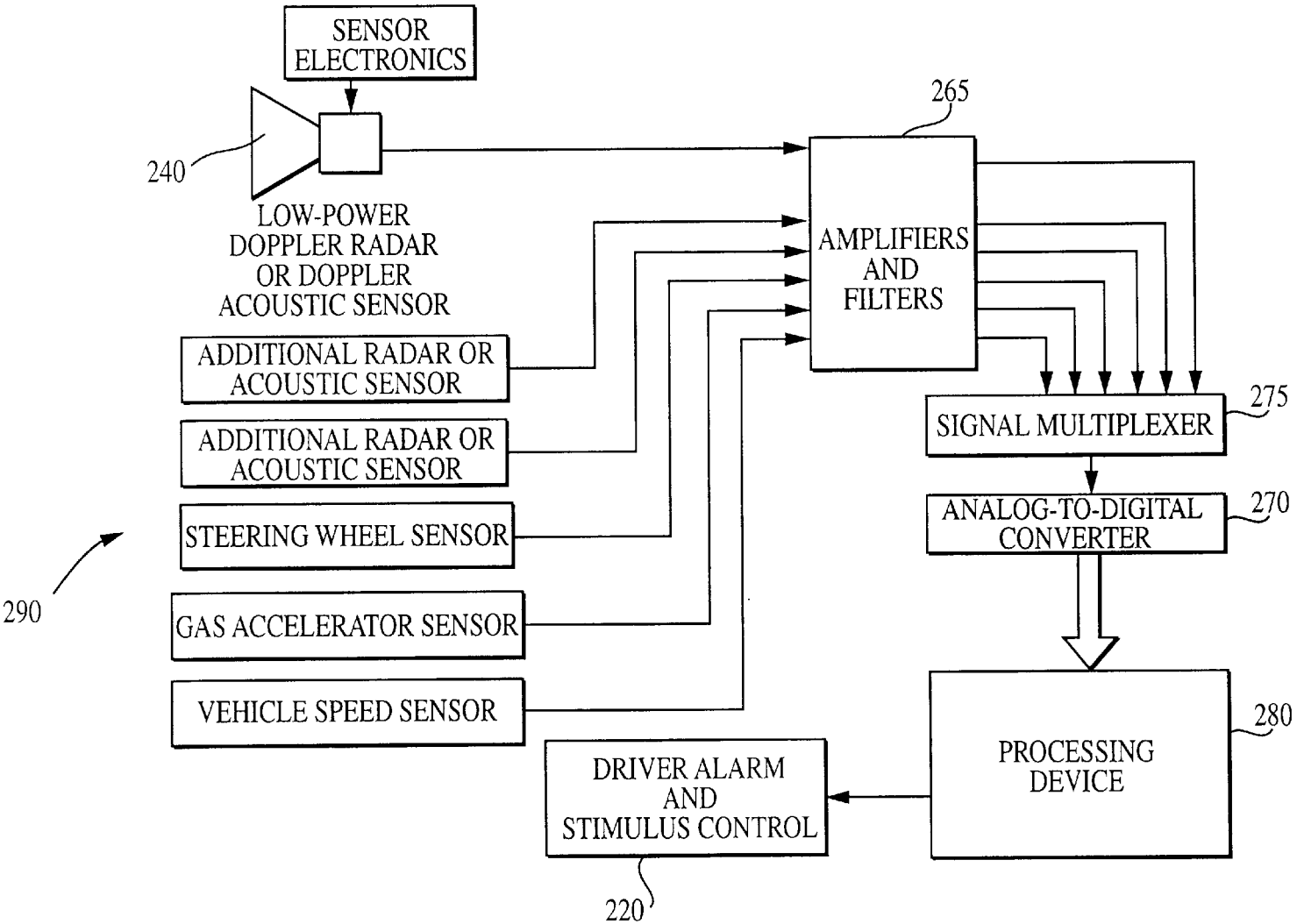
FIG. 3 is a schematic view of an embodiment of the control electronics of the alertness monitoring system according to the present invention, shown coupled to a plurality of sensors.

Referring now to FIG. 2, there is provided a schematic diagram of the various components of a preferred embodiment of control electronics 15 according to the present invention, shown connected to a single radar sensor. FIG. 3 is schematic diagram similar to FIG. 2, depicting the various components of a preferred embodiment of control electronics 15 according to the present invention, shown connected to a plurality of radar sensors, such as to the radar sensors shown in FIG. 1. As seen in FIGS. 2 and 3, the control system according to the present invention uses a feedback approach to monitor the alertness of a subject.

As seen in FIG. 2, the control electronics (e.g., 15 in FIG. 1) for a single sensor may include an amplifier and filter 260, analog-to-digital converter 270, processing device 280, alarm and stimulus control 220, sensor electronics 250, and, in addition, an optional visual display 225. The components of the control electronics are in signal communication with sensor 240. As seen in FIG. 3, the control electronics 15 for multiple sensors may include a plurality of amplifiers and filters 265 for the plurality of sensors 240 and 290, and a signal multiplexer 275, in addition to the components shown for use with a single sensor in FIG. 2, such as an analog-to-digital converter 270, processing device 280, alarm and stimulus control 220 and optional visual display 225. Examples of multiple sensors are: radar or acoustic sensors to monitor a subject in a non-contact manner, such as eye blink, general movement, heart rate and respiration, in addition to sensors for measuring steering wheel rotation, gas accelerator (throttle) position and/or vehicle speed.

The shown embodiment of the control electronics is by no way meant to be limiting of the scope of the present invention, at least to the extent that the present invention would include within its ambit the use of separate control electronics, such as the one shown in FIG. 2, for each individual sensor. It is further to be understood that sensor electronics 250 includes conventional electronics for operating a Doppler sensor, such as a Doppler microwave sensor or a Doppler acoustic sensor, as would be readily recognized by one skilled in the art.

The function of the amplifier and filter 260 or 265 is to amplify the signal from the sensor or sensors. One of the basic purposes of the filters at this stage of the invention is to prevent signal overload of the analog-to-digital converter and to provide a function that small sensor signals could be further amplified to increase the dynamic range of the invention. Each filter may in turn be a bandpass, low-pass, high-pass, notch or a serial or parallel combination of the preceding filters for filtering the signal from one or more sensors. The exact type of filter depends on the nature of the sensor and the desired effect. For example, to extract eye blink signals, a bandpass filter would be used that has a range of about 1–30 Hz. On the other hand, to suppress extraneous signals such as cab vibration, a notch-filter would be used centered on the offending cab vibration frequency. It is further to be understood that the appropriate filter to be used would be readily recognized by one skilled in the art. The sensor signal will be further filtered in the processor algorithm described below.

An important function of the filters, where necessary, is to extract and discard from the signals they receive those signals that do not correspond to the signals of the parameters being measured. The necessity of extracting and discarding signals would arise in cases where the signals correspond not only to the parameter being measured, such as eye blink, but to a range of extraneous factors. These extraneous factors could include additional movement within the truck cab such as that produced by the vibration of the cab due to its motion and those normally produced by the driver during wakeful driving, such as through steering, looking in mirrors, adjusting positions in the cab seat, adjusting the radio, drinking and eating.

The frequency of each filter depends on the base frequency of the sensor to which it corresponds, and further on the parameter being sensed, partly because the shift in the frequency of the signal being returned to the radar sensor is, as is well know, directly proportional to the base frequency being emitted by the sensor. For example, to the extent that, in the shown embodiment of FIG. 1, sensor 11 senses eye blink and general movement, a corresponding filter in the amplifier and filter may be selected to filter the eye blink data and another corresponding filter in the amplifier and filter may be selected to filter the general movement data. By way of example, a bandpass filter provided to filter the eye blink data may have a frequency band anywhere between about 1–100 Hz, optimized based on the base frequency of its corresponding sensor, as would be recognized by one skilled in the art. For example, eye blinks have been observed to be of a bipolar nature and to last, on average, about 136 milliseconds. Based on the latter duration, a given base frequency of a Doppler radar sensor would yield a signal in a predictable frequency range. The band of a corresponding bandpass filter would therefore be chosen based on providing a frequency window within which the predictable frequency range would be situated.

The analog-to-digital converter 270 transforms the analog signal from the sensor or sensors to digital form for further handling by processing device 280. Where multiple sensor signals are to be processed, as in the arrangement of FIG. 3, an analog signal multiplexer 275 multiplexes the signals before it transmits them to the processing device. It is to be noted that an important function of the processing device 280 is to process the signals it receives through an alertness monitoring algorithm (AMA) and to determine, based on the signal, whether or not the stimulus control 220 must be activated. The output of the AMA therefore controls the function of the stimulus control 220. The AMA among other things allows the comparison of signals from one or more sensors with a corresponding threshold value before a decision as to whether stimulus control 220 must be activated. A more detailed description of the AMA follows further below with regard to FIGS. 7–10 and the setting of the threshold value which can be predetermined or adaptive. The processing device preferably comprises a digital electronic device (DED) including at least one of a microprocessor, a digital signal processor (DSP) and/or an application specific integrated circuit (ASIC). A selection of the type of processing device to be used is dependent on the complexity of the control circuit being used and of the functions to be performed.

Stimulus control 220 may be any device capable of eliciting a response, either in the form of an action or of a physiological response, in the subject being monitored as a function of a processing of one or more of the sensor signals through the AMA. Stimulus control could include, by way of example only, an alarm such as alarm 21 in FIG. 1, or a set of lights that could blink on and off, or an aromatherapy device adapted to release calming or energizing scents toward the subject. For example, according to one embodiment of the AMA, once the sensor signals suggest the onset of driver drowsiness, that is, once the AMA determines that the signals have reached a predetermined threshold or thresholds for drowsiness, processing device 280 could control stimulus control 220, such as alarm 21 in FIG. 1, to emit a noise for waking the driver. In addition, a visual display 225, such as a monitor, may be used in conjunction with stimulus control 220 which may be arranged to show signals for eye blink, respiration and heart rate in wave form.

Figure 4:
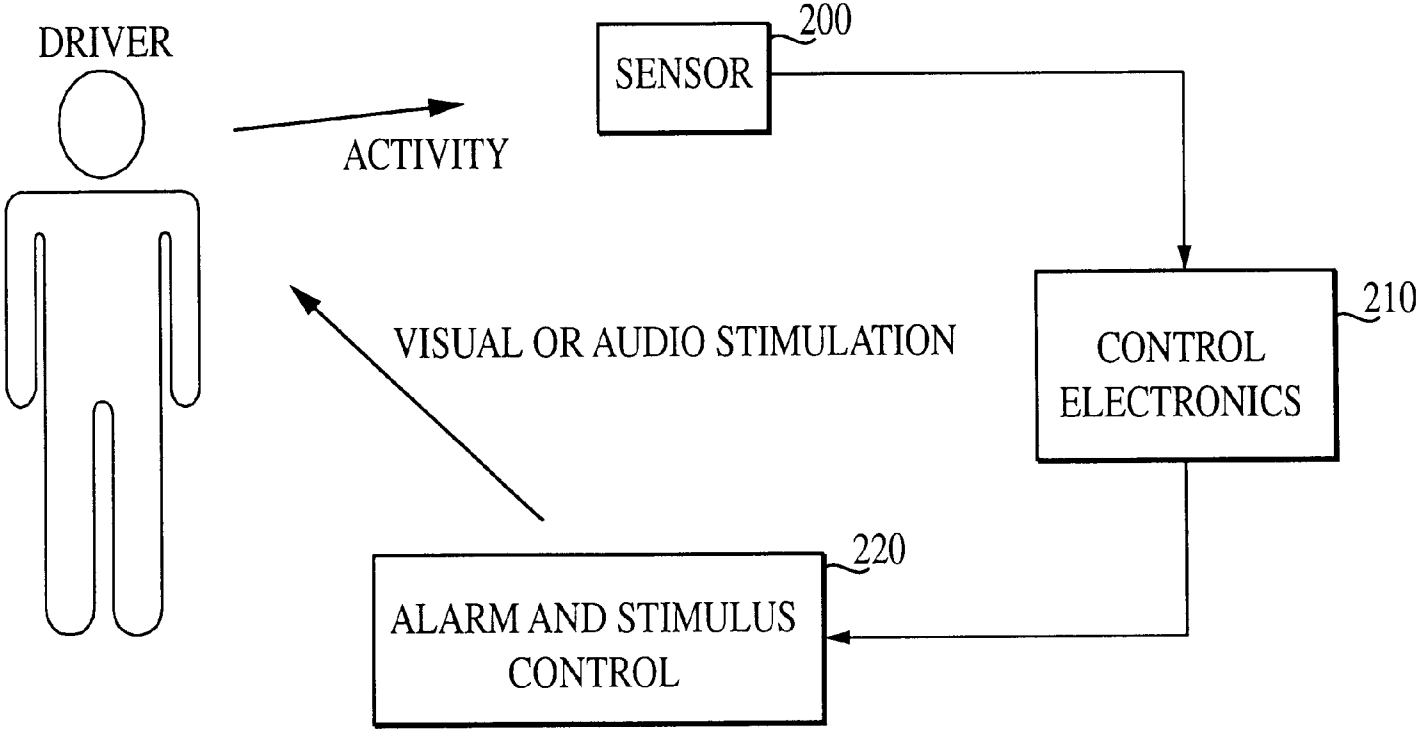
FIG. 4 is a schematic diagram of an embodiment of an alertness monitoring system according to the present invention including a single sensor.
Figure 5:
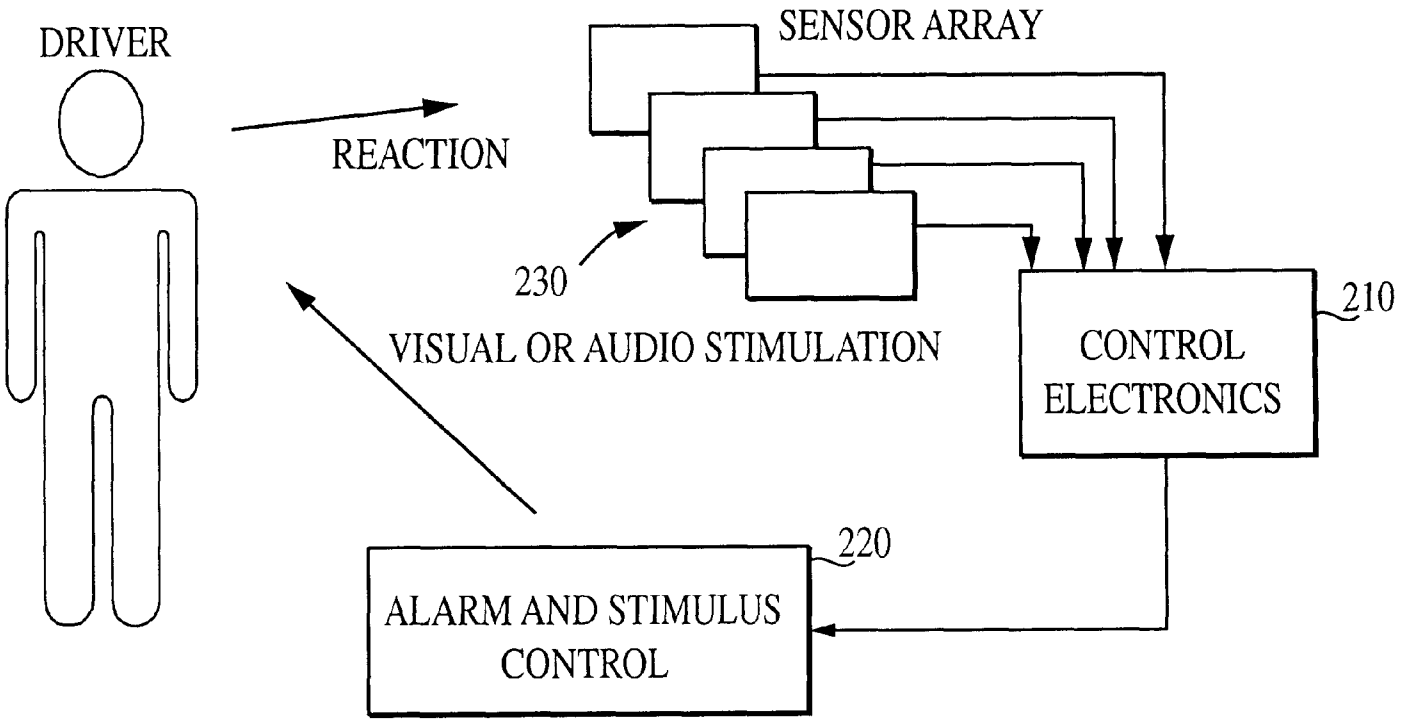
FIG. 5 is a diagram similar to FIG. 4, showing an embodiment of an alertness monitoring system according to the present invention including a plurality of sensors.

A simplified diagram of an embodiment of an alertness monitoring system according to the present invention is shown in FIGS. 4 and 5. FIG. 4 shows the alertness monitoring system with respect to a single sensor 200, and FIG. 5 shows the alertness monitoring system with respect to a plurality of sensors 230. The shown alertness monitoring system uses the feedback approach to prevent a subject from losing alertness. The basic operation of the feedback approach of the embodiment of the alertness monitoring system according to the present invention shown in FIGS. 4 and 5 is described below.

Subject activity, such as eye blink and general movement, is monitored by the sensor(s). The sensor(s) record the activity level. As an example of activity level, the root-mean-square (RMS) power in the sensor(s) could be used. Another example of an activity level is eye blink. The output of the sensor(s) is monitored as a function of time by control electronics 210. The control electronics include a processing device which processes digitized sensor data through the AMA. As an example of the AMA operation, when the activity level of the subject as measured by the sensor(s) falls below a predetermined threshold level for a predetermined period of time, a first stage alarm may be triggered in the alarm and stimulus control 220. The stimulus control 220 in turn gives a signal to the subject, such as blinking lights or an audio sound. The subject's response determines what happens next. If the subject responds to the stimulus control signal by increased activity, such as by turning his/her head to view the stimulus control, the sensor(s) record(s) this increased activity. The AMA then resets the first stage alert trigger. The increased activity is a sign that the subject is awake and paying attention to his/her related activities. However, if the subject does not respond to the stimulus control signal, as noted by no change in activity, it is assumed that the subject is not awake or not paying attention to driver related activities. The AMA may then respond with a second stage alert which is more pronounced than the first stage alert, such as a louder audio sound level, an increased level of flashing lights, or a light color change. The objective at this point is to get the subject's attention.

Figures 6A, 6B, 6C, 6D:
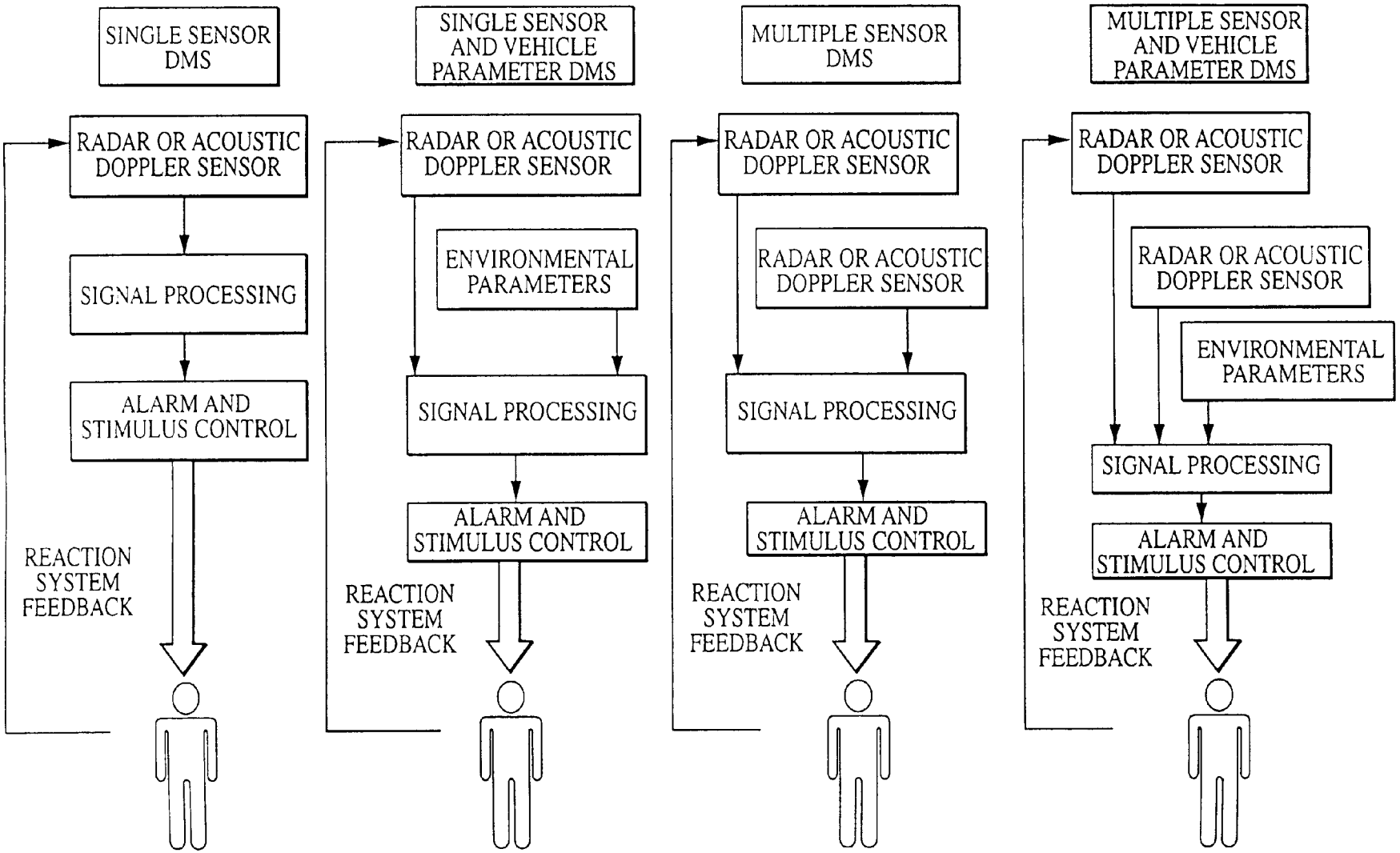
FIGS. 6*a*–6*d* show, respectively, four embodiments of configurations for the alertness monitoring system according to the present invention.

FIGS. 6*a*–6*d* show four basic configurations for the alertness monitoring system according to the present invention. As seen in FIG. 6*a*, a single radar or acoustic Doppler sensor could be provided to measure a single parameter pertaining to the alertness of a subject, such as eye blink or general movement. The single sensor in FIG. 6*a* could, additionally, be used to measure more than one parameter, such as eye blink in conjunction with general movement. In FIG. 6*b*, the single sensor shown in FIG. 6*a* could be supplemented with additional sensors which measure environmental parameters pertaining to the environment in which the subject is situated, such as, in the case of a driver, vehicle parameters including steering wheel rotation, vehicle speed, gas accelerator position, etc. In FIG. 6*c*, a plurality of radar or acoustic Doppler sensors are provided, each being adapted to measure one or more parameters pertaining to the alertness of the subject, such as eye blink, general movement, heart rate and respiration. FIG. 6*d* additionally shows the possibility of combining a plurality of radar or acoustic Doppler sensors, such as those in FIG. 6*c*, with a plurality of sensors for measuring environmental parameters, such as those show in FIG. 6*b*. FIGS. 6*a*–6*d* therefore show four possible configurations of the alertness monitoring system according to the present invention, from more simple in FIG. 6*a* to more complex in FIG. 6*d*. The configuration in FIG. 6*a* would provide a cost effective way of monitoring alertness, while the configuration in FIG. 6*d* would afford an alertness monitoring system offering a higher confidence level than the level afforded by the embodiments of FIGS. 6*a*–6*c*. For each configuration, the signals are processed through a signal processing step of the control electronics as shown, for example, in FIGS. 2 and 3 before a decision is made by the AMA as to whether the stimulus control must be activated.

Referring now to FIGS. 1–3, one embodiment of the operation of the shown alertness to monitoring system of the present invention is described. A first step involves the triggering of the alertness monitoring system. For example, when driver 23 in FIG. 1 climbs into the truck cab 3 and starts the engine, the monitoring system of the invention may be triggered in a conventional manner to start its operation. In the alternative, the triggering of the monitoring system may be set to occur when the truck cab is actually placed in motion. In the latter event, a motion detection device (not shown) for the vehicle may be coupled to the control electronics in order to trigger the same, in a manner readily recognizable by one skilled in the art. It is evident, however, that the alertness monitoring system according to the present invention may be triggered in any suitable manner depending on the subject and the environment in which measurements are being taken. When the monitoring system is triggered, the sensor or sensors start emitting microwaves or acoustic waves toward the subject, and preferably start recording in processing device 280 a data stream of the Doppler effect of the returned signals corresponding to the parameters being measured during a predetermined measurement time interval (PMTI). The PMTI may be, for example, about 10–30 minutes for measuring drowsiness, and, especially eye blink. It should be understood, however, that a different PMTI could be chosen for each parameter being measured, for example, a PMTI of 10–30 minutes being possible for the measurement of drowsiness. The returned signals from the sensors are fed through an amplifier and filter and analog-to-digital converter as described with respect to FIGS. 2 and 3 above, after which they are further processed by the processing device 280. For the arrangement of FIG. 1, the returned signals from the sensors usually correspond not only to eye blink, general movement, heart rate and respiration, but to a range of movements within the truck cab, including those produced by the vibration of the cab due to its motion and those normally produced by the driver during wakeful driving, such as through steering, looking in mirrors, adjusting positions in the cab seat, adjusting the radio, drinking and eating. In an adaptive AMA, once the extraneous signals are extracted and discarded by the processing device 280, the processed signals are recorded in the memory of processing device 280. At the outset, the thus recorded signals provide an initial profile, hereinafter referred to as an initial index profile, of standard signals corresponding to the particular subject in an awake state, such as a particular driver 23 driving in the truck cab 3. After the passage of a time period equal to PMTI, the initial index profile is stored in the memory of the processing device for further use, and a new profiling session is started during a subsequent PMTI. During each profiling session, the signals are used by the processing device to calculate a parameter index at predetermined time intervals within the PMTI. The parameter index corresponds to each parameter being sensed, and is preferably obtained by being normalized based on corresponding values within the index profile already stored in memory. For instance, according to a preferred method, the parameter indices may be normalized by being divided by a maximum value of a parameter index in the index profile already in memory. The predetermined time interval (PTI) for calculating a parameter index corresponding to drowsiness, or drowsiness index (DI), for example, could be about 30 seconds to 5 minutes. The DI is indicative of the state of wakefulness of the subject during the PMTI, and, preferably, represents the fraction of time during which the eyes close within the predetermined time interval. The DI could, for example, correspond to measurements of the general movement of the subject. In addition, measurements of eye blink may be a secondary component in DI. When the DI is above a predetermined threshold index, as predetermined based on the best available correlation with the onset of drowsiness, this means that the alertness of the subject is impaired. Processing device 280 thus may use the AMA to assess changes in the DI within the PMTI, and, should the changes indicate the onset of drowsiness, the relay will send an activation signal to stimulus control 112 to activate the same. If, for example, stimulus control 220 is alarm 21, then, an activation of the same will result in a sounding of the alarm to wake the driver. A monitoring of eye blink and general movement presents a preferred way of monitoring drowsiness under the scope of the present invention.

Where signals for heart rate and respiration are being processed, the threshold index could be, for example, a maximum allowable heart rate or breathing rate before the stimulus control is activated. Monitoring heart rate and/or breathing is particularly useful in the context of containing phenomena such as high stress environments. In such a case, once a threshold index is reached, the processing device could be set to activate the stimulus control to, say, activate a voice control that informs the driver to relax, or release calming aromatherapy scent.

In addition, according to the present invention, for a sensor which senses two parameters, such as both eye blink and general movement, instead of using two bandpass filters, one corresponding to eye blink and the other to general movement, which would represent a preferred embodiment of the control electronics according to the present invention, it would be possible in one embodiment of the present invention to use a single bandpass filter with a variable frequency band. In such a case, the bandpass filter may be set to have a wider frequency band for filtering returned signals corresponding to movements encompassing larger displacements, such as general movement and eye blink together. The AMA could monitor the returned signals, such as those corresponding to general movement and eye blink, and once a threshold index is reached, the processing device could be set to regulate the bandpass filter to filter signals through a narrower frequency band corresponding to signals for movements limited to smaller displacements, such as eye blink. For example, in the case of general movement and eye blink being monitored together, upon the threshold index being reached, the processing device would know that the subject has stopped moving as such as before, and that, therefore, eye blink should be monitored to detect drowsiness, hence a narrowing of the frequency band of the bandpass filter. Thereafter, eye blink would be monitored in the manner described above using the DI to detect whether the threshold index for drowsiness has been reached, at which point the processing device may activate stimulus control 220. When the frequency band of the bandpass filter is narrowed, the control electronics are in effect "sensitized" to focus in on the signals for a particular parameter, such as eye blink frequency.

The operation of a preferred embodiment of an alertness monitoring system according to the present invention will now be described in relation to the diagram of FIG. 7, and in relation to the flowcharts in FIGS. 8, 9 and 10.

Figure 7:
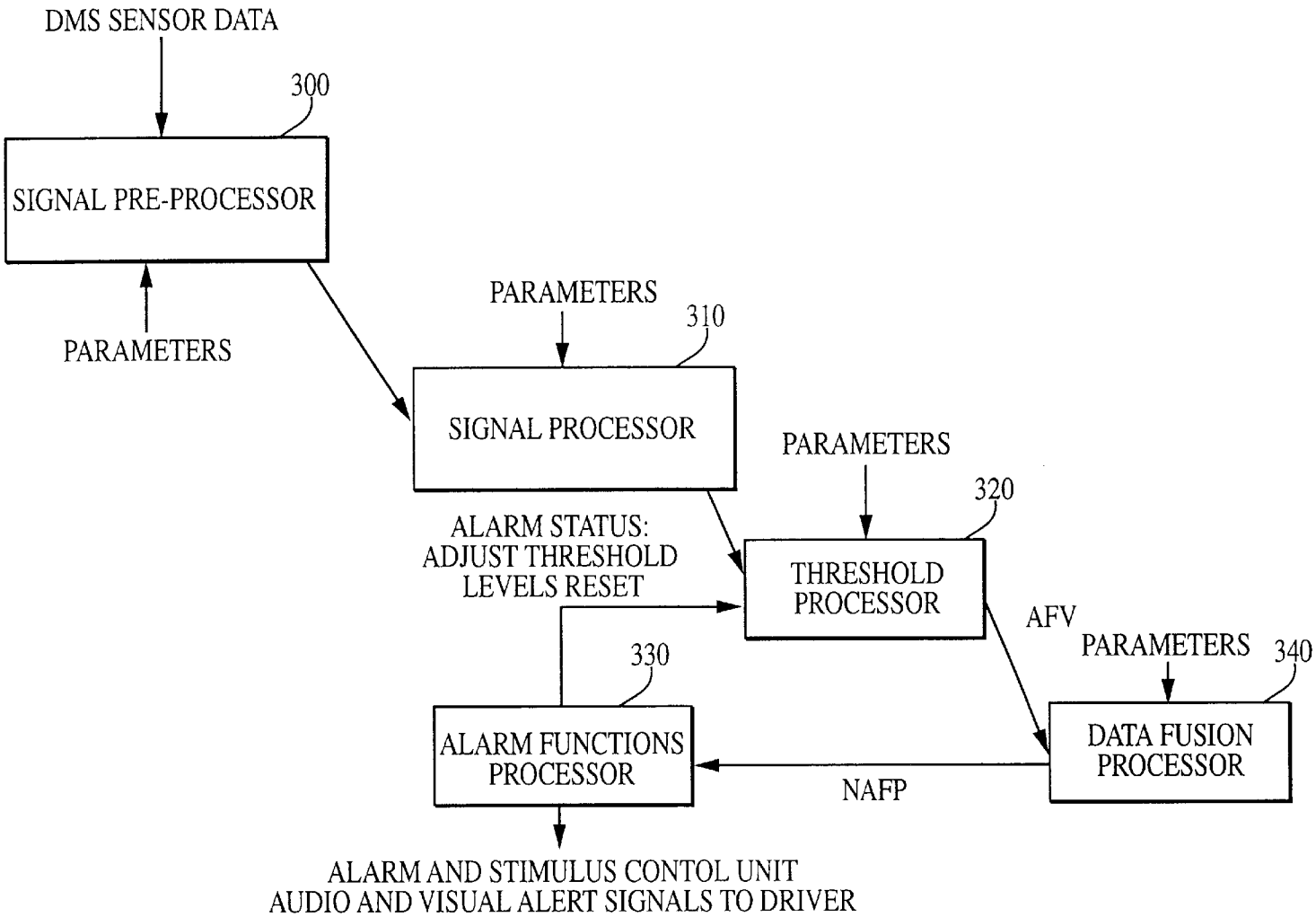
FIG. 7 is a diagram of the interrelationship between components of a preferred embodiment of a processing device according to the present invention.

FIG. 7 shows a simplified diagram of the alertness monitor algorithm and the interrelationship of the algorithm's sub-components called processors. As seen in the embodiment of FIG. 7, the processing algorithm according to the present invention incorporates a signal preprocessor 300, a signal processor 310, a threshold processor 320, a data fusion processor 340, and an alarm functions processor (AFP) 330. Therefore, the processing algorithm shown in FIG. 7 is divided into five basic sub processors. The basic operation of the processing algorithm shown in FIG. 7 involves reading sensor signals, checking signal validity, filtering signals where necessary, extracting signals pertaining to a parameter or parameters of interest from the signals, applying a threshold to the signals of interest and calculating an alert flag value (AFV) if multiple sensors are used, fusing AFV's to calculate a normalized alarm function parameter (NAFP), and using the NAFP to control the stimulus control unit.

Each sub processor 300, 310, 320, 330 and 340 has parameters controlling the way in which the processing algorithm behaves. These parameters vary depending on the complexity of the alertness monitoring system, as suggested, for example, in the configurations shown in FIGS. 6*a*–6*d* above. The operation of the components of the processing algorithm shown in FIG. 7 will now be described in relation to FIGS. 8 and 9.

As sensor data emerging from the analog-to-digital converter 270 emerges therefrom, it is first presented to the signal preprocessor 300 at step 400. The signals contain information regarding the subject being monitored, such as, information regarding eye blink, general movement, heart rate, and respiration. The signal preprocessor performs two basic functions. It verifies at step 405 that the sensor signals are valid and, at step 410 filters the sensor signals. Step 405, that is, the verification of the validity of sensor signals is a step readily recognizable by one skilled in the art of operating sensors. Sensor data validation at step 405 is accomplished by examining the signal to see whether it is within preset limits and has time history changes that would indicate that real physical measurements are being monitored. For example, where driver alertness is being monitored, if the vehicle speed sensor were within preset limits but had no reasonable variations about a measured mean speed, then the speed sensor would be classified as non-functioning. Preferably, if critical sensors were not functioning, an error message would be noted and the alertness monitoring system would indicate a malfunction. The sensor data stream is preferably sent to a bank of digital filters during step 410. The function of these filters is to remove extraneous electrical and/or environmental noise and to extract from the signals desired frequency content pertaining to the parameters of interest. As an example, eye blink signals from a Doppler radar sensor had frequency characteristics in the range of 1–30 Hz. Therefore, a band-pass filter with a 1–30 Hz pass band would be used to process the Doppler radar sensor signal. Another example would be steering wheel motion. Important information is contained in low frequency motion and therefore, the signal would be low pass filtered from approximately 0 to 0.5 Hz. Other sensors have different characteristic frequency content and may be filtered with the appropriate type of filter and the appropriate frequency settings as would be readily appreciated by one skilled in the art.

Signal processor 310 operates on signals outputted from preprocessor 300 to process the signals at step 415. One or more signal processors may be applied to the signals depending on the type of signals. One of several types of signal processors may be applied to radar and/or acoustic Doppler sensor signals according to the present invention. Preferably, signal processors performing a calculation of RMS signal power, or performing an application of a matched filter may be employed.

Calculation of RMS power is straightforward for one skilled in the art. The RMS power would be an indicator of the general activity level of a subject. However, the resulting RMS power should preferably be filtered before sending the result to threshold processor 320. The filter parameters may be fixed or part of an adaptive approach where the time constant of the filter is adjusted based on certain environmental parameters. For example, where the alertness of a driver is being monitored, the time constant of the filter may be adjusted for environmental parameters such as driving condition, time of day, previous vehicle speed profile, previous driver alertness levels, and similar inputs. One preferred way of processing the data or signals according to the present invention involves matched filter processing, according to which signals with well defined characteristics may be extracted by the signal processor. The signals may include, for example, eye blink, heart rate, and respiration signals. This type of processing is also called "feature extraction," since a certain parameter or feature in the signals is identified and extracted by the processor. The characteristics of the parameter(s) to be extracted are known in advance and are contained in memory in the processor in a replica database thereof. In one implementation of the matched filter, the signal is convolved with the replica of the parameter of interest. The result of the convolution is a data time series whose amplitude is a measure of the match of the data signal with the replica. Large relative amplitudes would indicate a high correlation with the replica signal thus indicating the occurrence of the parameter under study, such as, for example, eye blink.

For, environmental parameters, such as, in the case of monitoring the alertness of a driver, wheel motion, vehicle speed, gas accelerator operation, and similar parameters, the signal processor calculates the mean and variance of the signals as a function of time. The time window for calculations of these functions is typically several seconds.

Threshold processor (TP) 320 takes the results from the SP 310 and calculates whether a possible impairment of alertness, such as a drowsy driver event pertaining to the subject has occurred at step 420 and at query 425. Once impairment of alertness has been detected, the TP sets an alert flag at step 430. A threshold processor is a well know signal processing tool in the art. Basically, when a signal amplitude rises above or below a predetermined threshold limit for a predetermined time interval, that is, through hysteresis, the threshold is said to have been reached. When the threshold is reached, an alert flag is set by the TP. The value of the alert flag is proportional to a difference between a threshold value and the actual value of the signal amplitude. The alert flag value is a measure of the confidence level of the thresholded event. TP 320 generates the alert flag in a continuous fashion, and, therefore, the confidence level in this threshold event can change with time.

Once an alert flag has been set, the TP continues to monitor the conditions it is designed to monitor. If the condition that caused the alert in the first place is no longer valid, the TP resets a flag. The reset alert flag is transmitted to the next processing step, which involves the data fusion processor (DFP) 340.

The TP can be one of two types: a fixed parameter processor or variable parameter processor. In the fixed parameter version, the amplitude and hysteresis values of the thresholds for the different signals would be constants. In the variable parameter version, the amplitude and hysteresis values would depend on additional parameters such as subject history, sensor filter time constants, time of day, etc. A fuzzy logic approach is preferable in the present invention because it is well suited to the variable parameter version. Training of the fuzzy logic parameters in the environment of the subject, such as in an in-vehicle situation, would enhance the usability of the alertness monitoring system according to the present invention.

The threshold processing of the signals depends on the type of signals. Radar and acoustic signals measuring activity level, such as RMS power, use a simple TP. When the RMS power falls below a preset or variable power level for a preset or variable length of time, an alert flag is calculated. For signals from a match filter or similar feature extraction processor, the TP would preferably operate in a two step mode according to the present invention. The first step would set the threshold levels for the detection of the parameters of interest. The second operation would measure the parameter proper. The measurement of the parameter would then be used to calculate the alert flag. For example, low eye blink frequency would indicate that a subject is falling asleep. The threshold parameter or sensitivities are also preferably adjusted according to the present invention based on the status of the alarm function processor 330. If a previous alert has been sent to the subject indicating a possible impairment of alertness event and the condition continues for a preset period of time, then the alarm function processor would indicate that a continuing condition has been detected. Once a continuing condition is detected, the settings on the TP are preferably changed so that the levels would be more sensitive and alert flags would be calculated with a higher confidence level. Thus, this step involves the sensitization of the TP. The higher confidence level alert flags would trigger a more forceful response to the subject in the alarm functions processor 330, for example, a loud alarm could be used to awake a likely sleeping subject.

DFP 340 operates on data from the TP transmitted to it at step 435. For the case of multiple sensors, the DFP assigns a weighting function to the various sensor alert flags. The weighting of the different parameters according to the present invention depends on their correlation to alertness. For example, where parameters including eye blink, general movement, respiration and heart rate are being monitored, a higher weight could be assigned to eye blink and general movement, and a lower weight to heart rate and respiration. The DFP then adds the weighted alert flags at step 470, and calculates a normalized alarm function parameter (NAFP) between 0 and 1 at step 475. The NAFP provides a probability of the impairment of alertness event. A low value would indicate a low probability of an impairment of alertness event, and a high value a likely impairment of alertness event.

The AFP 330 monitors the value and the time history of the NAFP at step 430. The AFP would use the NAFP to decide what level of alert is to be sent to the alarm and stimulus 220 located near the subject and query 485. For low NAFP values, a warning signal would be sent at step 490 to the alarm and stimulus control indicating a low to moderate probability that the subject is becoming drowsy.

Figure 8:
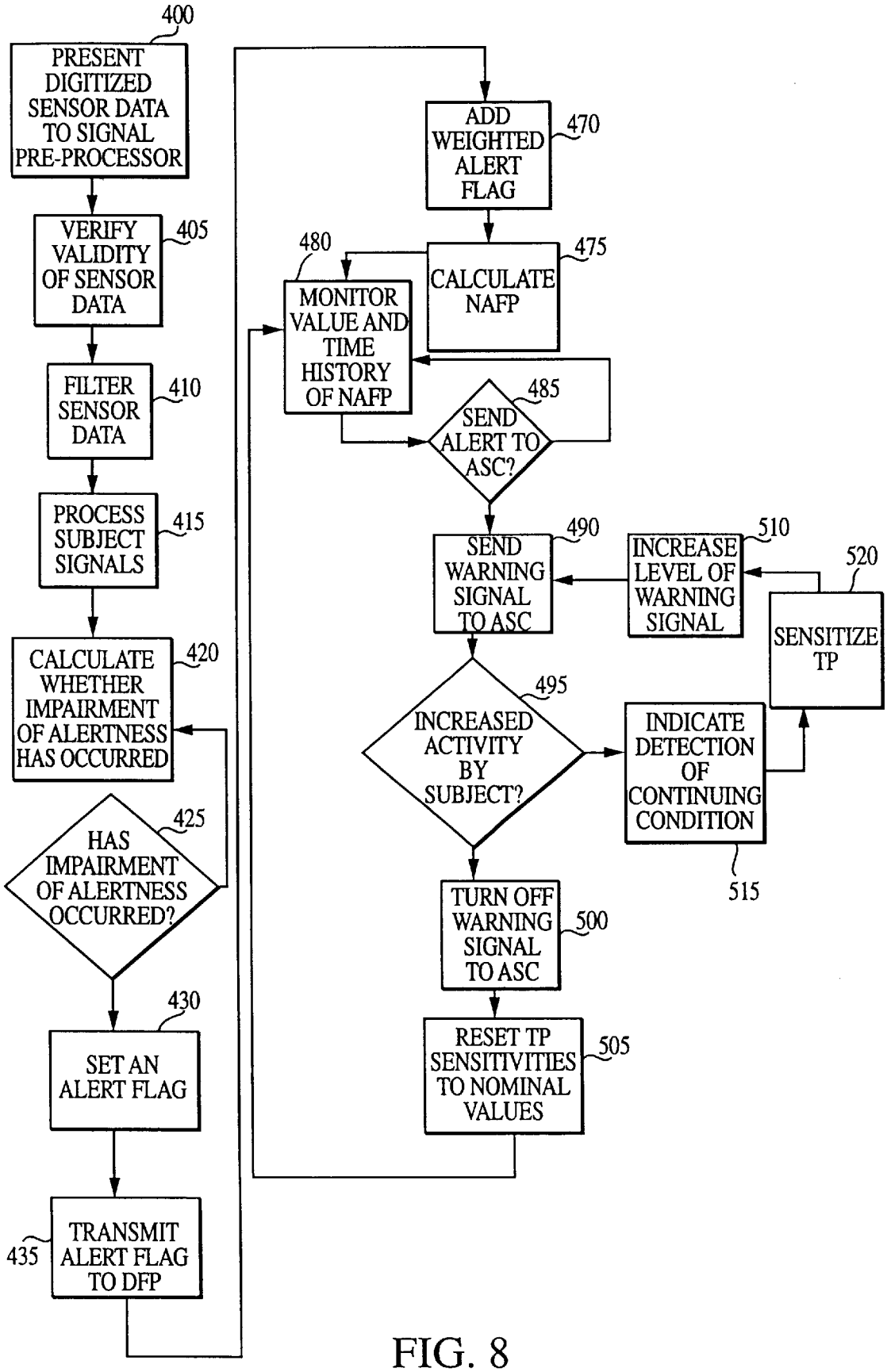
FIG. 8 is a schematic flow diagram of an algorithm used in processing the signals from sensors for alertness monitoring according to a preferred embodiment of the present invention.

With respect to FIG. 8 and the above-described steps, it is noted regarding step 430 that the setting of an alert flag involves the monitoring of signals pertaining to all of the parameters being monitored in order to determine a probability of an impairment of alertness. Additionally, where a single parameter is being sensed, after query 425, the stimulus control is activated if the answer to query 425 is yes, the steps following step 425 pertaining to the processing of a plurality of signals then no longer being applicable. In addition, if the answer to query 485 regarding whether an alert should be sent to the stimulus control is no, the NAFP will continue to be monitored at step 480 until the answer to query 485 is yes. Moreover, after step 505, that is after sensitivities of the TP are reset to their nominal values, again the NAFP will continue to be monitored at step 480, keeping in mind that, preferably, according to the present invention, the stream of signals from the sensors is a continuous one.

If the subject responds to the ASC unit by increased activity as measured by one of the radar or acoustic Doppler sensors (query 495), the alert flags generated by the TP would stop, the NAFP would decrease in value and the AFP would turn off the warning signal to the ASC unit at step 500. At this point, the AFP would send a reset to the TP at step 505 so that the TP sensitivities would be reset to their nominal values. For example, the subject's natural response to the warning signal would be looking at the unit. The action of turning the head or making a gesture at the unit would be enough to raise the RMS power level in the sensors, thus indicating that the subject is awake.

If the subject does not respond to the first warning signal from the ASC unit, the sensors would not register a change in signal. Thus, the AFP would indicate the detection of a continuing condition at step 515, and sensitize TP parameters at step 520. A low or increasing NAFP would continue to be measured by the AFP. The AFP would increase the level of the warning to the subject at step 510.

If the subject responds to the stimulus control signal by increased activity, such as by turning his/her head to view the stimulus control, the sensors record this increased activity. The program then resets the first stage alert trigger. The increased activity is a sign that the subject is awake and paying attention to subject related activities. If the subject does not respond to the stimulus control signal as noted by no change in activity as recorded by the sensors, it is assumed that the subject is not awake or is not paying attention to subject related activities. The AMA responds with a second stage alert which is more pronounced such as with a louder audio sound level, an increased light level, a flashing light, or a light color change. The objective at this point is to get the subject's attention.

In addition to the above description of the TP, there are three basic approaches to the threshold processing according to the present invention. These approaches include: fixed thresholding, adaptive thresholding and data fusion from multiple sensors.

In fixed thresholding, a threshold approach may be used to detect the onset of subject drowsiness. The RMS power in the Doppler radar signal may be calculated by the control electronics. A low-pass filter with a time constant of several seconds may be applied to the signal. When the RMS power falls below a preset power level for a preset length of time, that is, during a trigger time interval (TTI), an alert may be set. For laboratory proof-of-concept development, this approach has been sufficient to demonstrate the utility of the alertness monitoring system. The problem with a fixed preset power level and preset time interval is that activity usually varies by subject, subject environment, and time of day.

A more robust approach to the detection of an impairment of alertness according to the present invention would be to use an adaptive thresholding approach. Adaptive thresholding is a well known technique used in signal processing to evaluate data that is constantly changing. For example, a correlation has been shown between an increased risk of driver drowsiness and the length of time a vehicle has been in motion, the time of day, and whether driving is being done at night time. Hence, the AMA would use different parameters, based on information about the above factors, such that previous driver history and activity level would be used to set the threshold parameters in the TP. These threshold parameters would set the parameters of the low-pass filter, such as time constant and filter type and order and of the TTI. For an example of adaptive thresholding, see FIG. 9, the description of which follows further below.

An even more robust approach to the detection of an impairment of alertness according to the present invention would be to use adaptive thresholding with multiple sensors. A multiple sensor fusion method would then be used to set the subject alerts. It has been shown in numerous research areas that improved system performance and a high confidence level can be obtained by combining information from multiple sensors to make a decision such as a decision as to whether the subject is drowsy. Many different data fusion algorithms exist in the literature. These include, best sensor, Naïve Bayes, Dempster-Shafer, voting and linear discriminate.

Figure 9:
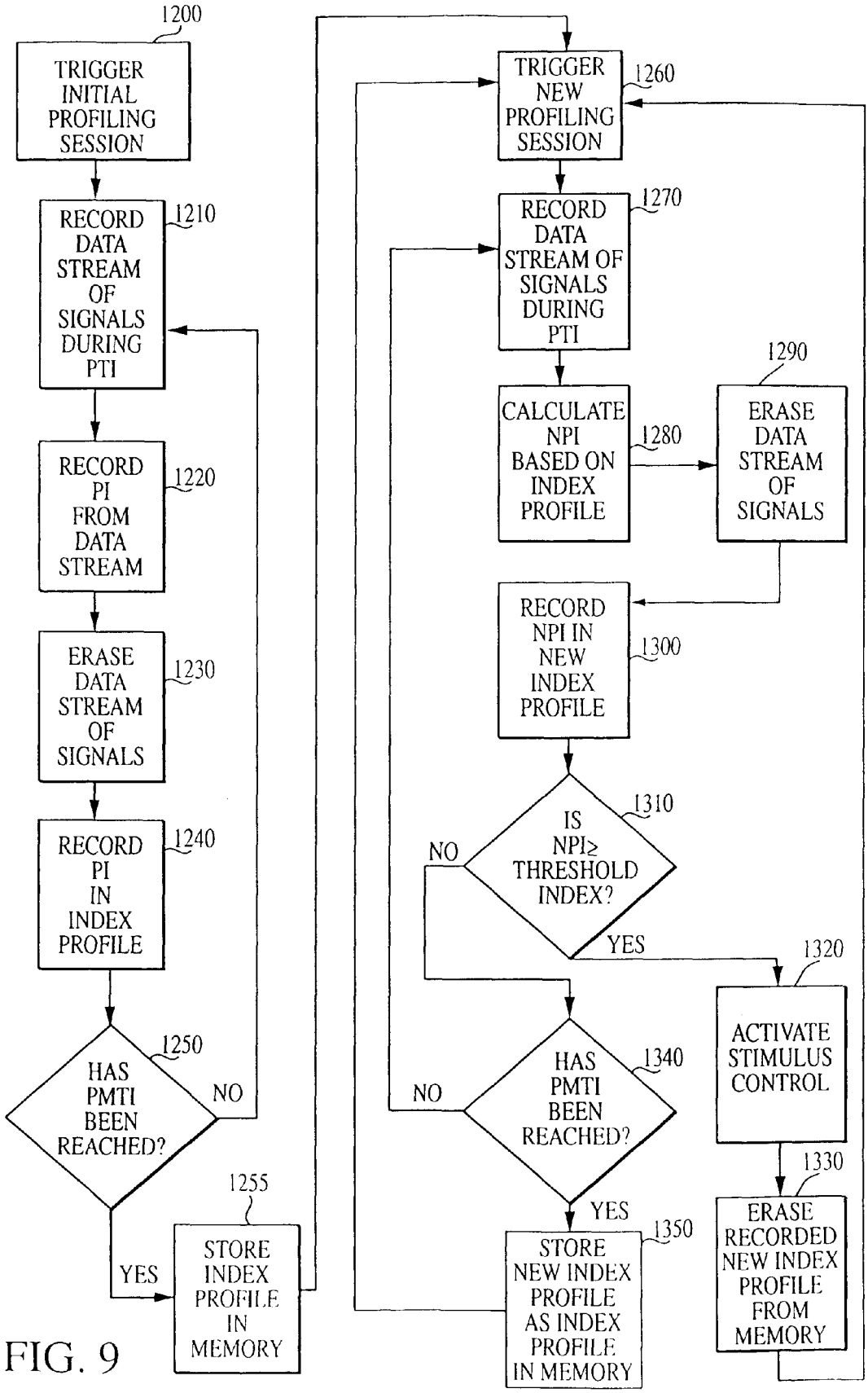
FIG. 9 is a schematic flow diagram of an algorithm used in processing the signals from the 15 sensors for alertness monitoring according to another embodiment of the present invention.

Referring now to FIG. 9, an alternative AMA to the one shown in FIG. 8 for processing signals corresponding to each parameter being measured is set forth in the form of a flow chart it being understood that certain sub-algorithms shown in FIG. 9 could be used in the algorithm of FIG. 8. It is to be noted at the outset that the flowchart of FIG. 9 represents an adaptive thresholding algorithm for processing the signals from the sensor or sensors, as will be explained further below. Nevertheless, the present invention includes within its ambit various manners of running the algorithm, such as through an absolute algorithm, as will also be explained below.

In FIG. 9, a first step 1200 involves the triggering of an initial profiling session, which corresponds to a predetermined time interval or PMTI during which a profiling of the signals is effected. The PMTI could be different for each parameter being sensed. The function of this initial profiling session would be to obtain an initial index profile of the signals for the parameter being sensed. At step 1210, the data stream of the signals is recorded during a predetermined time interval PTI, for example in the memory of the processing device, and, thereafter, at step 1220, a parameter index PI is recorded based on the recorded data stream. The PI could, for instance, represent Doppler power signals corresponding to a parameter being measured within PTI, and could, for instance, correspond, preferably, to a time average of the power of the signals, or, in the alternative, to their standard deviation or range. In order to conserve memory space, at step 1230, the data stream of signals could optionally be erased after the PI is recorded for each PTI. At step 1240, the PI is recorded in memory for generating an initial index profile. For instance, where drowsiness is being monitored, the initial index profile would provide a profile of signals corresponding to a wakeful state of the subject during the first, say, 10 to 30 minutes of being monitored depending on the PMTI selected. Optionally, the recorded PI is displayed on a visual display at a step not shown. A query is made at step 1250 as to whether the PMTI has been reached. If not, the recording of the PI into the initial index profile continues, until the answer to query 1250 is yes. At this point, the initial index profile is recorded in memory for further use.

At this point, a new profiling session is triggered at step 1260. At step 1270, a data stream of the signals during PTI is recorded in memory, and, at step 1280, a normalized parameter index, or NPI, is calculated based on the values in the index profile already stored in memory. According to a preferred method, the normalization of the index profile is effected by dividing the parameter index by the maximum parameter index of the index profile stored in memory. Where an adaptive AMA is used, as shown in FIG. 9, the maximum parameter index would be variable, whereas, where an absolute AMA is used, the maximum parameter index would be a constant. The NPI is comparable to the NAFP of FIG. 8. The values in the index profile provide a reference point for alertness monitoring during a given PMTI to allow a comparison of the signals from one PMTI to the next. After the NPI is calculated, the data stream of signals is optionally erased from memory at step 1290 in order to conserve memory space. Then, at step 1300, the NPI is recorded to generate a new index profile. At step 1310, a query is made as to whether NPI is equal to or greater than a threshold index. In the alternative, the NPI could be monitored (not shown) to see whether it is simply greater than the threshold index. If the answer to query 1310 is yes, the stimulus control is activated at step 1320, after which the new index profile is erased from memory at step 1330, and a new profiling session restarted at step 1260. If the answer to query 1340 is no, then, a further query is made as to whether the PMTI has been reached. If so, the new index profile is stored at step 1350 as the index profile to be used for the calculation of subsequent NPI's, and a new profiling session is re-started at step 1260.

As previously mentioned, the flow-chart according to FIG. 9 corresponds to an adaptive approach to the AMA according to the present invention, meaning that the value or values based on which normalized values are calculated change as a function of each profiling session, as in step 1350 in FIG. 9. However, the present invention includes within its ambit the use of an absolute algorithm where the values based on which normalized values are calculated remain constant. In such a case, a flow chart corresponding to the absolute approach would be similar to the one shown in FIG. 9, except that steps 1260, 1300, 1330, 1340 and 1350 would be obviated if an initial index profiling session is still desired, and that steps 1200–1260, 1300, 1330, 1340 and 1350 would be obviated if an index profile or maximum value is already stored in the memory of the processing device. Nevertheless, the embodiment of the AMA according to the present invention depicted in the flowchart of FIG. 9 allows the tailoring of the alertness monitoring system according to the present invention to the particular behavior of a given subject. The above advantage is achieved through the use of steps that allow the normalization of data based on pre-recorded signal profiles corresponding to a previous profiling session for the subject, thus allowing a comparative monitoring of subject behavior from one profiling session to the next.

The present invention further relates to an alertness monitoring system comprising: a Doppler sensing means disposed to sense a parameter pertaining to the subject, the sensing means being one of an acoustic sensor and a microwave sensor; means adapted to be coupled to the sensing means for processing signals therefrom thereby generating processed signals and for determining whether an impairment of alertness event pertaining to the subject has occurred; and means coupled to the means for processing for providing feedback to the subject regarding a determination of whether an impairment of alertness event pertaining to the subject has occurred. An example of these means is shown in FIGS. 2 and 3 described above.

It will be apparent to those skilled in the art that various modifications and variations can be made to the embodiments of the present invention without departing from the spirit or scope of the present invention. Thus, it is intended that the present invention cover other modifications and variations of this invention within the scope of the appended claims and their equivalents.

What is claimed is:

1. An alertness monitoring system for monitoring the alertness of a subject, comprising:

a Doppler sensor adapted to sense a parameter pertaining to the subject, the sensor being one of an acoustic sensor and a microwave sensor; and control electronics adapted to be coupled to the sensor for processing signals therefrom, the control electronics including:

a processing device having an alertness monitoring algorithm embedded therein adapted to process the signals from the sensor thereby generating processed signals and to determine whether an impairment of alertness event pertaining to the subject has occurred, wherein the processing device has memory therein, the algorithm in the processing device being adapted to monitor the signals from the sensor by performing a comparison of the processed signals with a predetermined threshold value stored in the memory of the processing device by:

calculating, within a predetermined time interval, a normalized parameter index for the parameter being sensed based on an index profile of the parameter being sensed already stored in the memory of the processing device; and comparing the normalized parameter index with a predetermined threshold index pertaining to the parameter being sensed; and a stimulus control coupled to the processing device and being controlled by the alertness monitoring algorithm for providing feedback to the subject based on a determination of whether an impairment of alertness event pertaining to the subject has occurred.

2. The alertness monitoring system according to claim 1, wherein the algorithm in the processing device generates an index profile of the parameter being sensed and stores the index profile in memory by recording, during a predetermined measurement time interval, each normalized parameter index calculated within a corresponding predetermined time interval.

3. The alertness monitoring system according to claim 2, wherein, if no normalized parameter index within the predetermined measurement time interval is greater than or equal to the threshold index, the algorithm in the processing device replaces, after each predetermined measurement time interval, the index profile already stored in the memory of the processing device with a most recently generated index profile.

4. The alertness monitoring system according to claim 3, wherein the processing device activates the stimulus control when a normalized parameter index is greater than or equal to the threshold index.

5. The alertness monitoring system according to claim 1, wherein the algorithm in the processing device generates an initial index profile and stores the initial index profile in memory by:

calculating, within the predetermined time interval, a parameter index for the parameter being sensed; and recording, during a predetermined measurement time interval, each parameter index for the parameter being sensed within each predetermined time interval.

6. The alertness monitoring system according to claim 5, wherein the parameter index corresponds to one of a time-average power signal from the sensor during the predetermined time interval, a standard deviation of the power signal from the sensor during the predetermined time interval and a range of the power signal from the sensor during the predetermined time interval.

7. The alertness monitoring system according to claim 1, wherein the control electronics further include:

an amplifier adapted to be coupled to the sensor for amplifying the signals therefrom thereby generating amplified signals;

a filter adapted to be coupled to the amplifier for filtering the amplified signals thereby generating filtered signals; and an analog-to-digital converter coupled to the filter for digitizing the filtered signals thereby generating digitized signals.

8. The alertness monitoring system according to claim 1, further comprising a plurality of Doppler sensors each being adapted to be disposed to sense a corresponding parameter pertaining to the subject, the sensors each being one of an acoustic sensor and a microwave sensor, wherein the control electronics are adapted to be coupled to each of the plurality of sensors.

9. The alertness monitoring system according to claim 8, further including a plurality of filters coupled to the sensors, wherein:

the plurality of sensors are set to operate based on different base frequencies with respect to one another; and the plurality of filters are set to filter the signals from the sensors through respective frequency bands corresponding to respective ones of parameters being sensed by the plurality of sensors, the filters thereby being adapted to separate the signals from the sensors into discrete signals corresponding to respective ones of the parameters being sensed.

10. The alertness monitoring system according to claim 9, wherein one of the parameters being sensed is eye blink, and wherein a frequency band of one of the plurality of filters corresponding to processed eye blink signals is about 1–100 Hz.

11. The alertness monitoring system according to claim 1, further comprising a filter coupled to the sensor, wherein:

the sensor is adapted to sense a plurality of parameters; and the filter is set to filter the signals from the sensor through variable frequency bands each of which corresponds to a signal representing a given one of the plurality of parameters.

12. The alertness monitoring system according to claim 1, wherein the parameter being sensed is at least one of eye blink, general movement, heart rate and respiration.

13. A method for monitoring the alertness of a subject comprising the steps of:

disposing a Doppler sensor to sense a parameter pertaining to the subject, the sensor being one of an acoustic sensor and a microwave sensor;

processing signals from the sensor through an alertness monitoring algorithm for generating processed signals;

determining whether an impairment of alertness event pertaining to the subject has occurred based on the processed signals, wherein the step of determining includes the step of comparing the processed signals with a predetermined threshold value wherein the step of comparing comprises the steps of:

calculating, within a predetermined time interval, a normalized parameter index for the parameter being sensed based on an already existing index profile of the parameter being sensed; and comparing the normalized parameter index with a predetermined threshold index pertaining to the parameter being sensed; and providing feedback to the subject based on a determination of whether an impairment of alertness event pertaining to the subject has occurred.

14. The method according to claim 13, further including the step of generating an index profile of the parameter being sensed by recording, during a predetermined measurement time interval, each normalized parameter index calculated within a corresponding predetermined time interval.

15. The method according to claim 14, further including the step of replacing, after each predetermined measurement time interval, the already existing index profile with a most recently generated index profile if no normalized parameter index within the predetermined measurement time interval is greater than or equal to the threshold index.

16. The method according to claim 13, wherein the step of providing feedback includes the step of activating a stimulus control when a normalized parameter index is greater than or equal to the threshold index.

17. The method according to claim 13, further including the step of generating an initial index profile by:

calculating, within the predetermined time interval, a parameter index for the parameter being sensed; and recording, during a predetermined measurement time interval, each parameter index for the parameter being sensed within each predetermined time interval.

18. The method according to claim 13, further including the steps of:

amplifying the signals from the sensor thereby generating amplified signals;

filtering the amplified signals by substantially extracting therefrom signals not pertaining to the parameter being sensed thereby generating filtered signals; and digitizing the filtered signals thereby generating digitized signals.

19. The method according to claim 13, further including the step of disposing each of a plurality of Doppler sensors to sense a corresponding parameter pertaining to the subject, the sensors each being one of an acoustic sensor and a microwave sensor, wherein the control electronics are adapted to be coupled to each of the plurality of sensors.

20. The method according to claim 19, further including the steps of:

operating the plurality of sensors based on different base frequencies with respect to one another; and filtering the signals from the sensors through a plurality of filters operating at respective frequency bands corresponding to respective ones of parameters being sensed by the plurality of sensors thereby separating the signals from the sensors into discrete signals corresponding to respective ones of the parameters being sensed.

21. The method according to claim 20, wherein one of the parameters being sensed is eye blink, and wherein a frequency band of one of the plurality of filters corresponding to processed eye blink signals is about 1–100 Hz.

22. The method according to claim 19, wherein the step of providing feedback to the subject includes the steps of:

setting an alert flag corresponding to each of a plurality of parameters being sensed by the plurality of sensors;

assigning a weight factor to each alert flag as a function of a correlation of each of the parameters to an impairment of alertness;

weighing each alert flag based on its corresponding weight factor thereby generating weighted alert flags;

adding the weighted alert flags to generate an alarm function parameter;

normalizing the alarm function parameter thereby generating a normalized alarm function parameter;

monitoring a value and time history of the normalized alarm function parameter;

comparing the normalized alarm function parameter to a predetermined threshold value; and activating a stimulus control to provide feedback to the subject if the normalized alarm function parameter has surpassed the predetermined threshold value.

23. The method according to claim 22, further including the steps of:

monitoring the subject for increased activity after the step of activating the stimulus control;

de-activating the stimulus control based on increased activity of the subject after the step of activating the stimulus control.

24. The method according to claim 23, further including the steps of:

increasing an intensity of feedback to the subject based on a lack of increased activity of the subject after the step of activating the stimulus control;

monitoring the subject for increased activity after the step of increasing the intensity of feedback to the subject; and de-activating the stimulus control and resetting an intensity of the feedback to a predetermined initial value based on an increased activity of the subject after the step of increasing the intensity of feedback to the subject.

25. The method according to claim 13, wherein the sensor is adapted to sense a plurality of parameters, the method further including the step of using a filter to filter the processed signals through variable frequency bands each of which corresponds to signals representing a given one of the plurality of parameters.

26. An alertness monitoring system comprising:

a Doppler sensing means disposed to sense a parameter pertaining to the subject, the sensing means being one of an acoustic sensor and a microwave sensor;

means having a memory and adapted to be coupled to the sensing means for processing signals therefrom thereby generating processed signals and for determining whether an impairment of alertness event pertaining to the subject has occurred by performing a comparison of the processed signals with a predetermined threshold value stored in the memory of the means for processing signals by:

calculating, within a predetermined time interval, a normalized parameter index for the parameter being sensed based on an index profile of the parameter being sensed already stored in the memory of the means for processing signals;

comparing the normalized parameter index with a predetermined threshold index pertaining to the parameter being sensed; and means coupled to the means for processing for providing feedback to the subject regarding a determination of whether an impairment of alertness event pertaining to the subject has occurred.

* * * * *